US008256865B2

(12) United States Patent
Martinez-Guillen et al.

(10) Patent No.: US 8,256,865 B2
(45) Date of Patent: Sep. 4, 2012

(54) VACUUM SOURCE CONTROL USING VIRTUAL PULSE-WIDTH MODULATION LEVELS

(75) Inventors: Abel Martinez-Guillen, Barcelona (ES); Raimon Castells De Monet, Barcelona (ES); Albert Perez-Madrigal, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 266 days.

(21) Appl. No.: 12/839,084

(22) Filed: Jul. 19, 2010

(65) Prior Publication Data

US 2012/0013668 A1 Jan. 19, 2012

(51) Int. Cl.
*B41J 29/38* (2006.01)

(52) U.S. Cl. ..... 347/16

(58) Field of Classification Search ..... 318/481, 318/482, 599
See application file for complete search history.

*Primary Examiner* — Stephen Meier
*Assistant Examiner* — Tracey McMillion

(57) ABSTRACT

An indication is received of a vacuum source level measured by a vacuum sensor in a printing device. The vacuum level is associated with a pulse-width modulation (PWM) level for a PWM controller. The measured vacuum level is compared to an expected vacuum level. The PWM level of the PWM controller is adjusted in view of the comparison to achieve a virtual PWM level.

11 Claims, 4 Drawing Sheets

VACUUM SOURCE CONTROL USING VIRTUAL PULSE-WIDTH MODULATION LEVELS

BACKGROUND

Many printers, including large format printers, hold down media in the print zone area using a vacuum system. The vacuum system includes a vacuum source whose power level depends on various factors, including the type and width of the media loaded. Vacuum systems may have low tolerance to vacuum variability and suffer low accuracy and reduced throughput for wider media due to constraints, for example, in the vacuum calibration process.

BRIEF DESCRIPTION OF DRAWINGS

The following description includes discussion of figures having illustrations given by way of example of implementations of embodiments of the invention. The drawings should be understood by way of example, not by way of limitation. As used herein, references to one or more "embodiments" are to be understood as describing a particular feature, structure, or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive.

DETAILED DESCRIPTION

Vacuum systems used in printers may be based on a closed-loop control that includes a pulse-width modulation (PWM) controller connected to a vacuum source and a vacuum sensor. Vacuum sources might include, for example, a vacuum blower. The closed-loop control system is designed to achieve and keep a target output vacuum level, perhaps within a threshold or tolerance.

Many PWM controllers have a short range of operational values. For example, a 5-bit resolution PWM controller is capable of setting its duty cycle in steps of 3.125% of the total PWM range, allowing space for controlling 32 different levels of vacuum. Higher resolution controllers (e.g., 6-bit, 8-bit, etc.) may offer more levels of vacuum control but are more expensive and, therefore, less desirable.

Several sources of vacuum variability exist including, but not limited to, media width, media substrate, media temperature, etc. A calibration process is often performed by the vacuum control system during the media load and corrections are made to compensate for the above-mentioned variability factors just before printing occurs. In one example, the calibration process involves setting the vacuum source to multiple different PWM levels during a media load and measuring the resulting vacuum level corresponding to each PWM level. With this information, a curve (e.g., a quadratic curve) can be defined that plots vacuum level against PWM level. Before the printing starts, the vacuum source is set at the PWM level which, based on the calculated curve, is expected to generate the target vacuum level. Then, just before printing starts (e.g., during the printer warm-up), the applied PWM level is finely corrected one or more times by increasing or decreasing the PWM level depending on the vacuum level measured by the vacuum sensor.

Given the combination of low resolution for the PWM controller and the vacuum variability factors described above, the resulting vacuum level may deviate outside of a threshold or tolerance value in relation to the target vacuum level. Depending on the media width, the error in the vacuum level after calibration could be, for example, up to ±40% of the target value.

Rather than incur the additional expense of a higher-resolution PWM controller, embodiments described herein enhance resolution in a PWM controller that is otherwise limited and/or provides insufficient resolution. In various embodiments, a hardware PWM controller is enhanced through software interpolation to generate multiple virtual PWM levels between real PWM levels available on the hardware PWM controller. For example, in a PWM controller with 32 real PWM levels, 9 virtual PWM levels might be created between pairs of real PWM levels to provide a total of 321 PWM levels. As used herein, the term "PWM levels" may include real PWM levels, virtual PWM levels or a combination of real and virtual PWM levels.

Figure 1:
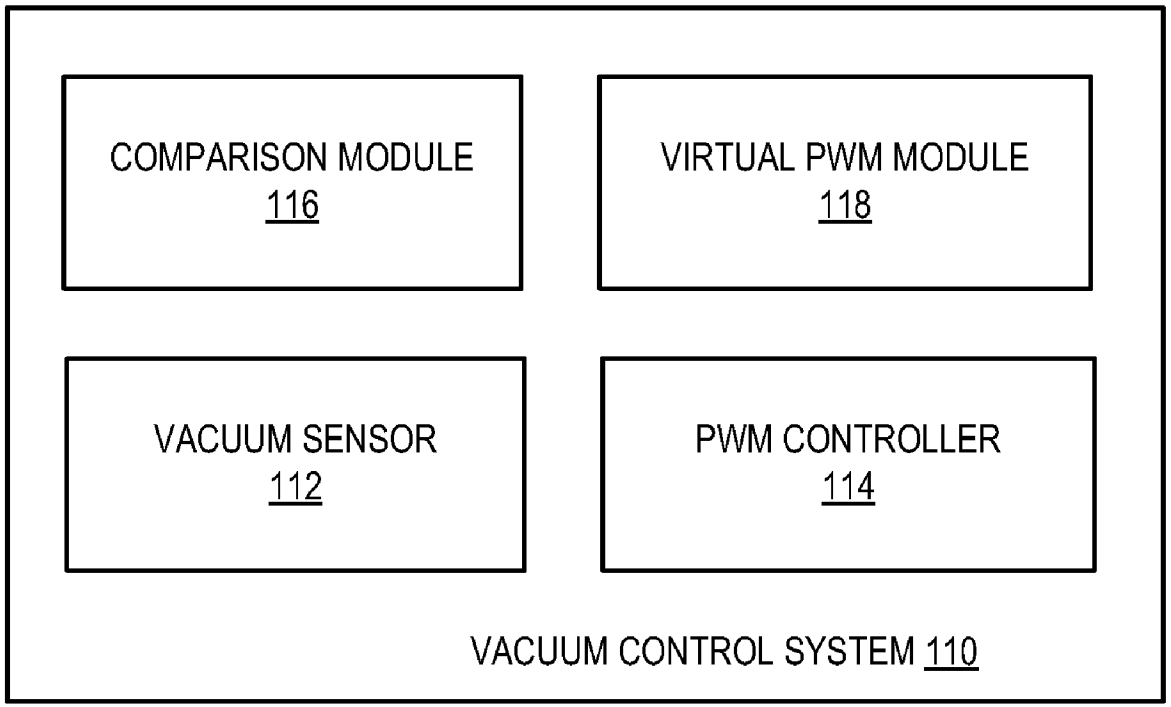
FIG. 1 is a block diagram illustrating a system according to various embodiments.

FIG. 1 is a block diagram illustrating a vacuum control system according to various embodiments. FIG. 1 includes particular components, modules, etc. according to various embodiments. However, in different embodiments, other components, modules, arrangements of components/modules, etc. may be used according to the teachings described herein. In addition, various components, modules, etc. described herein may be implemented as one or more software modules, hardware modules, special-purpose hardware (e.g., application specific hardware, application specific integrated circuits (ASICs), embedded controllers, hardwired circuitry, etc.), or some combination of these.

As shown, pulse-width modulation (PWM) controller 114 controls power to a vacuum source in a printing device. PWM controller 114 includes a limited number of real PWM levels. In other words, based on the hardware resolution, PWM controller 114 can be adjusted to one of a limited plurality of discrete operational duty cycles. For example, a PWM controller with 5-bit resolution may have 32 discrete operational duty cycles from which to select.

Vacuum sensor 112 measures the vacuum level created by the vacuum source operating at one of the real PWM levels. In particular, vacuum sensor 112 may be located near the media print zone and/or near the platen chambers on the printing device to detect and measure the vacuum level. In other embodiments, vacuum sensor 112 could be located at or near other points along the vacuum path between the vacuum source and the media print zone.

Comparison module 116 compares a measured vacuum level (i.e., measured by vacuum sensor 112) against an expected vacuum level. For example, the design of the vacuum system may dictate and/or predict that a certain PWM level corresponds to a particular vacuum level (e.g., vacuum strength, vacuum power, etc.). Thus, based on the PWM level applied by PWM controller 114, vacuum control system 110 expects a corresponding vacuum level. If comparison module 116 determines there is a difference between the measured vacuum level and the expected vacuum level for a particular PWM level, virtual PWM module 118 generates and/or sends signals to PWM controller 114 to adjust its PWM level to one of a plurality of virtual PWM levels. As discussed previously, virtual PWM levels are PWM levels that are between the discrete real operational levels of PWM controller 114. An example process for achieving the virtual PWM levels is described in more detail below. By adjusting the PWM level of PWM controller 114 to one of the plurality of virtual PWM levels, a modified vacuum level is created. Given the finer tuning resulting from the virtual PWM level, the modified vacuum level may more easily fall within an acceptable threshold or tolerance value of the target vacuum level. As needed, the calibration process may be repeated by comparing the modified vacuum level to the expected level and adjusting PWM controller 114 to a different PWM level (either virtual or real) to satisfy the target vacuum level within an acceptable threshold or tolerance value.

Figure 2:
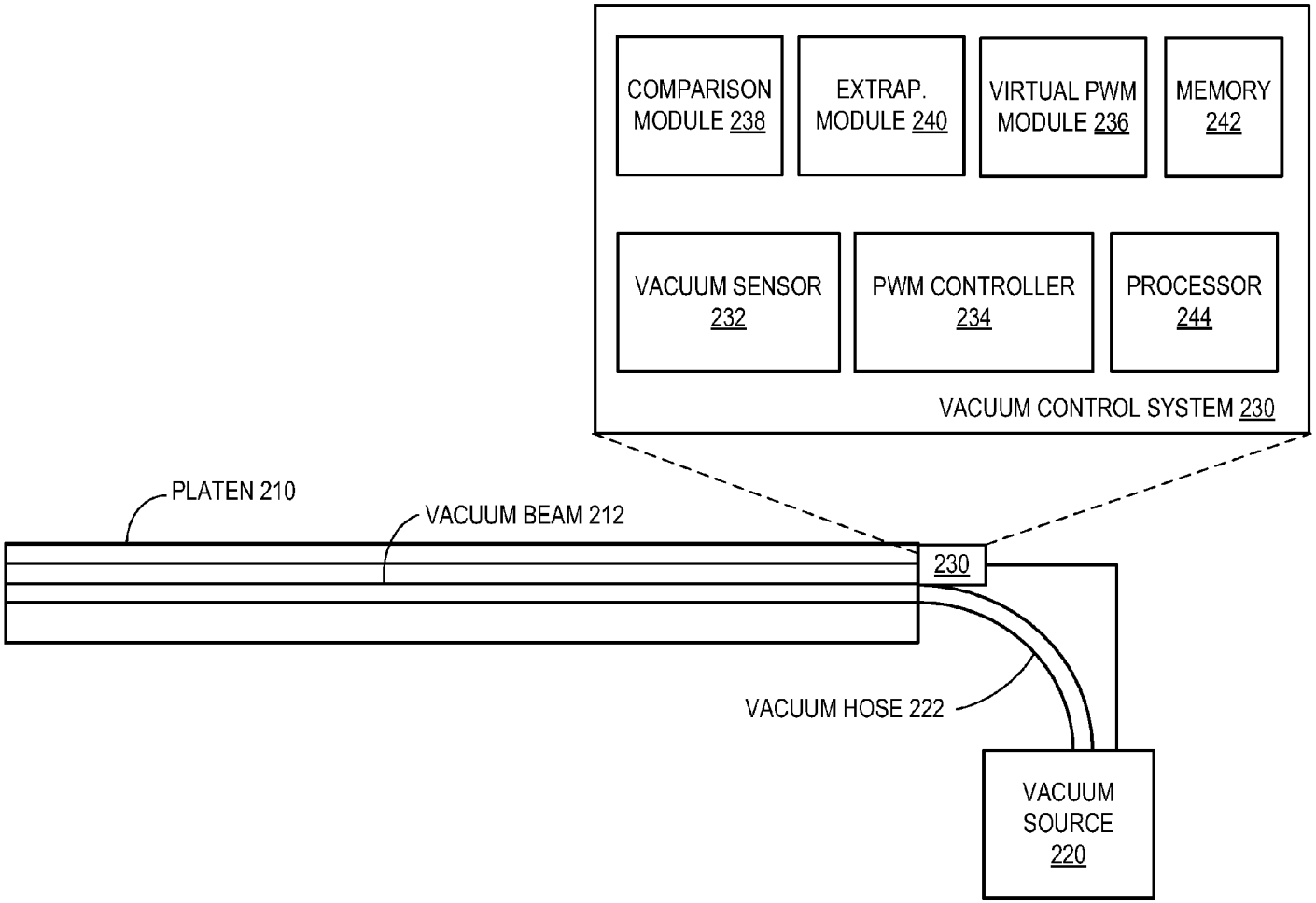
FIG. 2 is a block diagram illustrating a system according to various embodiments.

FIG. 2 is a block diagram of a system according to various embodiments. FIG. 2 includes particular components, modules, etc. according to various embodiments. However, in different embodiments, other components, modules, arrangements of components/modules, etc. may be used according to the teachings described herein. In addition, various components, modules, etc. described herein may be implemented as one or more software modules, hardware modules, special-purpose hardware (e.g., application specific hardware, application specific integrated circuits (ASICs), embedded controllers, hardwired circuitry, etc.), or some combination of these.

FIG. 2 shows vacuum control system 230 connected with various components in a printing device. In general, vacuum control system 230 may be integrated into any printing device that uses a vacuum source to hold media down in a print zone area. As shown, vacuum control system 230 is connected at or near a face of vacuum beam 212 and/or platen 210. For example, vacuum control system 230 may be located on a printed circuit assembly that attaches to a face of vacuum beam 212 and/or platen 210. Vacuum source 220 can be any source that creates and/or generates air pressure. Further details regarding the implementation of vacuum source 220 are beyond the scope of this disclosure—for purposes herein, it is sufficient to note that vacuum source 220, via a vacuum hose 222, creates a vacuum in platen chambers that exist between platen 210 and vacuum beam 212.

In various embodiments, PWM controller 234 is set to one of a plurality of PWM levels in connection with a print request. In particular, PWM controller 234 may be set to a real PWM level. For example, if PWM controller 234 has 5-bit resolution, it may be set to one of 32 real PWM levels. A PWM level signal is communicated to vacuum source 220 to control its power level. When vacuum source 220 is powered on, a vacuum level is created in the platen chambers that exist in the space between platen 210 and vacuum beam 212. Vacuum sensor 232 measures the vacuum level created by vacuum source 220.

Using at least the measured vacuum level, extrapolation module 240 extrapolates expected output vacuum levels corresponding to various input PWM levels. In some embodiments, vacuum control system 230 can alter the PWM level in PWM controller 234, measure a second vacuum level and use the two vacuum levels to extrapolate expected output vacuum levels corresponding to other PWM levels. In other embodiments, extrapolation module 240 uses the single measured value and one or more constant values (e.g., stored in memory 242) to extrapolate expected output vacuum levels corresponding to PWM levels.

In view of the expected output vacuum levels, a PWM level is automatically selected to produce a target vacuum level. In various embodiments, the initial selected PWM level is a real PWM level, though a virtual PWM level could also be selected. The selected PWM level is communicated to vacuum source 220, a new vacuum level is created, and vacuum sensor 232 measures the new vacuum level. Comparison module 238 compares the new vacuum level to the target vacuum level. If the new vacuum level falls within a threshold and/or tolerance value of the target vacuum level, then no adjustment is needed and the printing request is fulfilled. If, however, the new vacuum level falls outside of the acceptable threshold and/or tolerance value, then virtual PWM module 236 adjusts PWM controller 234 to one of a plurality of virtual PWM levels.

Virtual PWM module 234 sets (e.g., via software interpolation) multiple virtual PWM levels between two consecutive real PWM levels. For example, virtual PWM module 234 might set 9 virtual PWM levels between two consecutive real PWM levels. The virtual PWM levels are effectuated via a thread that is executed periodically (e.g., at each interruption). The thread causes PWM controller to switch between the two consecutive real PWM levels for a specified number of cycles. Assuming the time response of vacuum source 220 to be significantly longer than the interruption period (e.g., 10× longer), vacuum source 220 creates a natural low-pass filter.

The switching sequence that creates the virtual PWM levels causes PWM controller 234 to switch between two consecutive real PWM levels. The switching sequence could be dynamically generated at run-time or it could be predefined and stored in memory 242. Table 1 illustrates an example of a table that could be stored in memory 242 defining the cycle counts needed to achieve one of the virtual PWM levels:

TABLE 1

| Virtual PWM Level | Upper Cycles | Total Cycles |
|---|---|---|
| 1 | 1 | 10 |
| 2 | 1 | 5 |
| 3 | 3 | 10 |
| 4 | 2 | 5 |
| 5 | 1 | 2 |
| 6 | 3 | 5 |
| 7 | 7 | 10 |
| 8 | 4 | 5 |
| 9 | 9 | 10 |

In the example of Table 1, each row represents one virtual PWM level. The column "Upper Cycles" indicates the number of cycles that PWM controller 234 is set to the upper real PWM level of the two consecutive real PWM levels. For example, if the goal is to set PWM controller 234 to virtual PWM level 4 between real PWM levels 6 and 7, virtual PWM module 236 might dictate that PWM controller 234 be set to real PWM level 7 for two cycles. Given that the total number of cycles for achieving virtual PWM level 4 is five cycles (per the "Total Cycles" column), PWM controller 234 is set, in this example, to real PWM level 6 for three cycles. In other words, the difference between the total cycles and the upper cycles in Table 1 determines the lower cycles.

PWM controller 234 implements the switching sequence dictated by virtual PWM module 236 to achieve the selected virtual PWM level. Vacuum source 220 is powered in view of the virtual PWM level and vacuum sensor 232 again measures the output vacuum level. If the output vacuum level falls within an acceptable tolerance value of the target vacuum level, no further adjustment is needed. If, however, the output vacuum level does not fall within an acceptable tolerance value (e.g., as determined by comparison module 238), then vacuum control system 230 may perform adjustment operations again.

In alternate embodiments, various modules and components in vacuum control system 230 may be implemented as a computer-readable storage medium containing instructions executable by a processor (e.g., processor 244) and stored in a memory (e.g., memory 242).

Figure 3:
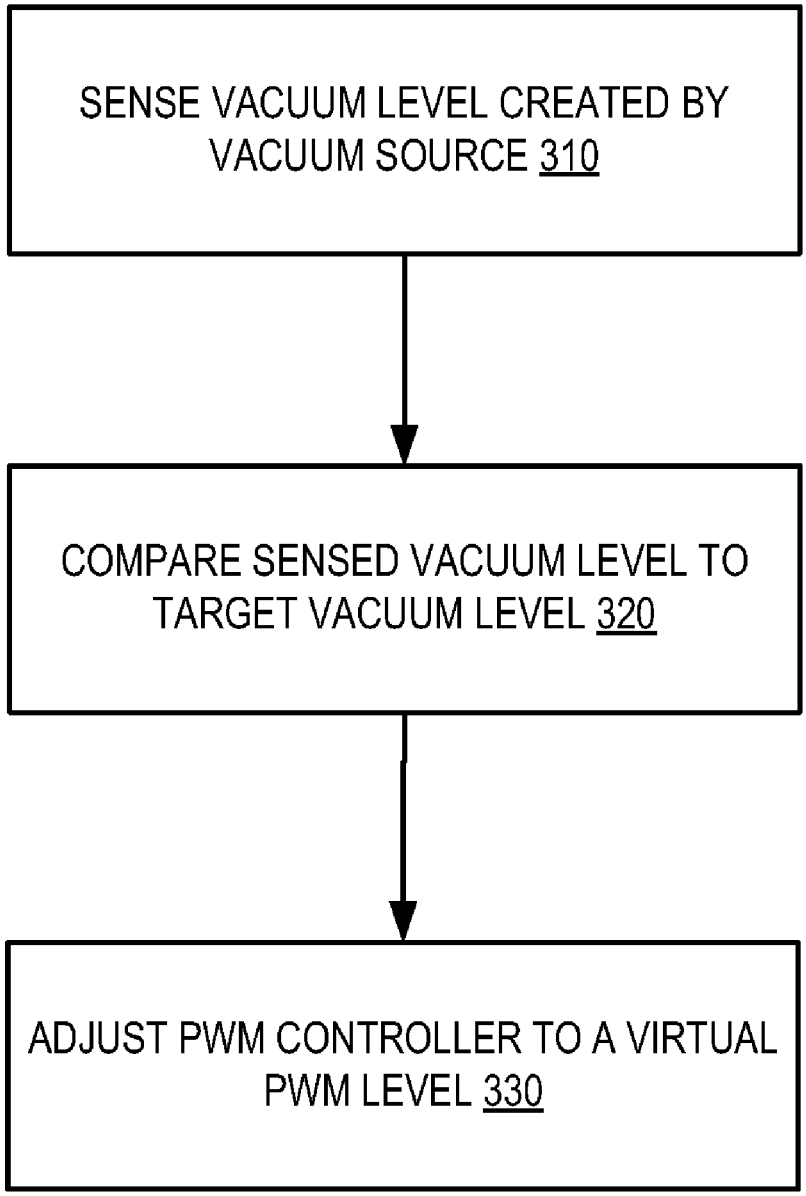
FIG. 3 is a flow diagram of operation in a system according to various embodiments.

FIG. 3 is a flow diagram of operation in a system according to various embodiments. FIG. 3 includes particular operations and execution order according to certain embodiments. However, in different embodiments, other operations, omitting one or more of the depicted operations, and/or proceeding in other orders of execution may also be used according to teachings described herein.

A vacuum control system senses 310 a vacuum level created by a vacuum source in a printing device. The vacuum source is controlled by a pulse-width modulation (PWM) controller. The vacuum control system compares 320 the sensed vacuum level to a target vacuum level. For example, the vacuum control system may determine whether the sensed vacuum level falls within a predefined threshold or tolerance value. In view of the comparison, the vacuum control system adjusts 330 the PWM controller to a virtual PWM level that is between two real PWM levels.

Figure 4:
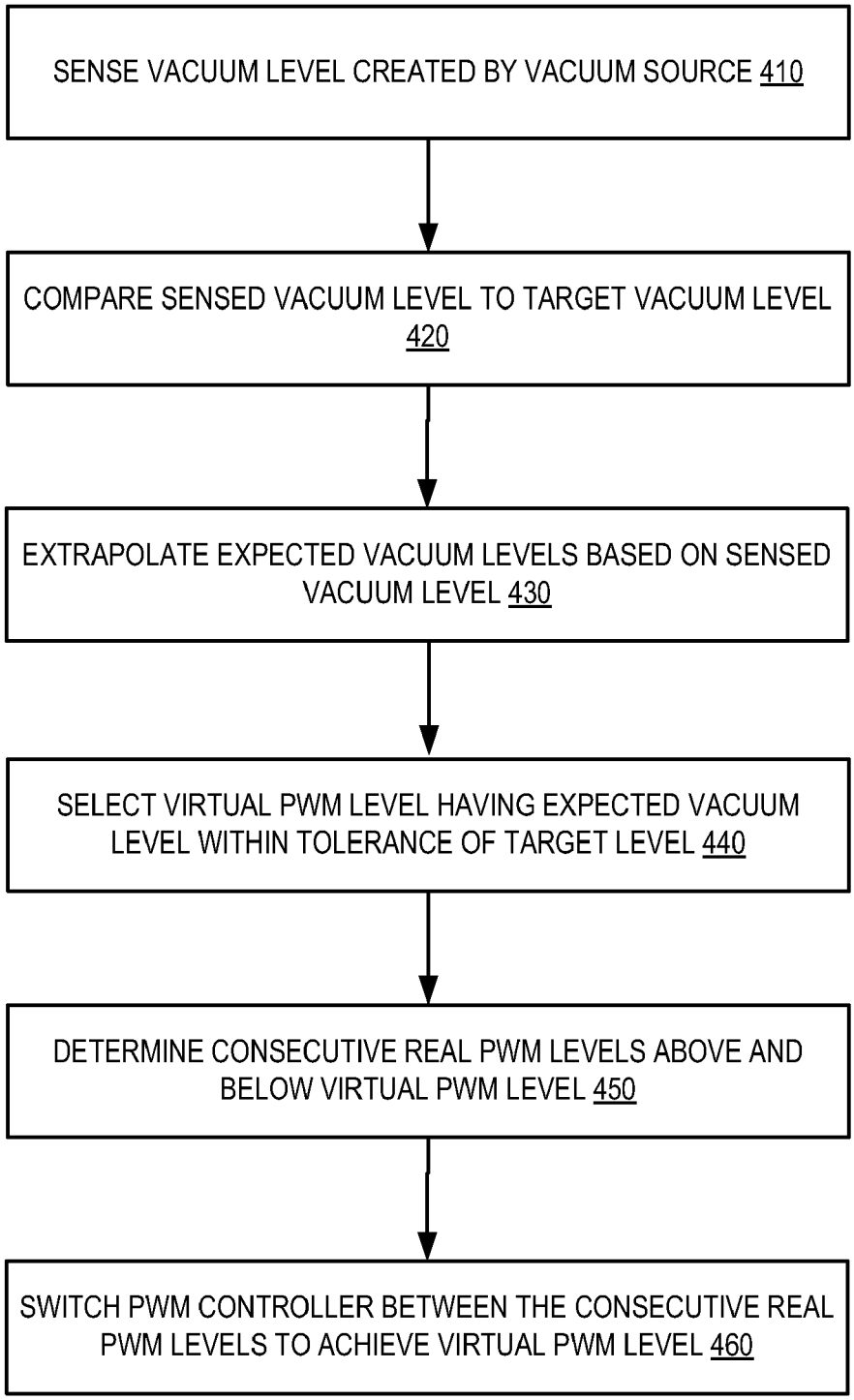
FIG. 4 is a flow diagram of operation in a system according to various embodiments.

FIG. 4 is a flow diagram of operation in a vacuum control system according to various embodiments. FIG. 4 includes particular operations and execution order according to certain embodiments. However, in different embodiments, other operations, omitting one or more of the depicted operations, and/or proceeding in other orders of execution may also be used according to teachings described herein.

In the vacuum control system, a vacuum level created by a vacuum source is sensed 410. The sensed vacuum level is compared 420 to a target vacuum level. Also, expected vacuum levels for corresponding real and virtual PWM levels are extrapolated 430 based on the sensed vacuum level. In some embodiments, the extrapolation is aided by the use of multiple sensed vacuum levels and/or one or more constant values to calculate a curve (e.g., a quadratic curve) that plots PWM values against expected vacuum output levels.

In view of the extrapolation, a virtual PWM level whose corresponding expected vacuum level is within a tolerance of a target vacuum level is selected 440. To produce the virtual PWM level, real PWM levels that are above and below the selected virtual PWM level are determined 450. In various embodiments, the real PWM levels are consecutive real PWM levels that are immediately above and below the selected virtual PWM level. However, in some embodiments, other real PWM levels may be used as long as one real PWM level is above the virtual PWM level and the other is below the virtual PWM level. A PWM controller is switched 460 between the real PWM levels that are above and below the virtual PWM level to achieve the virtual PWM level. For example, the PWM controller may be set to the higher of the two real PWM levels for a certain number of cycles and then switched to the lower real PWM level for a certain number of cycles to achieve the virtual PWM level. The cycle counts for each PWM level may be dictated by a table such as illustrated in Table 1 above. This pattern of switching based on cycle counts is continuously repeated to maintain the virtual PWM level. While the switching pattern is periodic over time in various embodiments, a non-periodic switching pattern could also be used to achieve a virtual PWM level.

Various modifications may be made to the disclosed embodiments and implementations of the invention without departing from their scope. Therefore, the illustrations and examples herein should be construed in an illustrative, and not a restrictive sense.

The invention claimed is:

1. A method, comprising:

sensing a vacuum level created by a vacuum source in a printing device where the vacuum source is controlled by a pulse-width modulation (PWM) controller;

comparing the sensed vacuum level to an expected vacuum level; and adjusting the PWM controller to a virtual PWM level that is between two real PWM levels.

2. The method of claim 1, wherein adjusting the PWM controller to a virtual PWM level comprises:

selecting a virtual PWM level from a plurality of virtual PWM levels; and periodically switching between the two real PWM levels to achieve the virtual PWM level.

3. The method of claim 2, wherein periodically switching between two real PWM levels comprises:

determining two consecutive real PWM levels where one of the consecutive real PWM values is higher than the virtual PWM level and one of the consecutive real PWM values is lower than the virtual PWM level;

switching the PWM controller between the two consecutive real PWM levels according to a predefined number of cycles for each of the consecutive real PWM levels corresponding to the virtual PWM level; and repeating the switching between two consecutive real PWM levels according to the predefined number of cycles for each of the consecutive real PWM levels.

4. The method of claim 2, wherein selecting the virtual PWM level comprises extrapolating expected vacuum levels for corresponding real and virtual PWM levels based at least in part on the sensed vacuum level; and selecting a virtual PWM level whose corresponding expected vacuum level is within the tolerance for a target vacuum level.

5. A vacuum control system, comprising:

a pulse-width modulation (PWM) controller to control power to a vacuum source in a printing device via a plurality of real PWM levels;

a vacuum sensor to measure a vacuum level created by the vacuum source operating a PWM level;

a comparison module to compare the measured vacuum level against an expected vacuum level; and a virtual PWM module to adjust, in view of the comparison, the PWM controller to a virtual PWM level that is between two real PWM levels.

6. The vacuum control system of claim 5, wherein the virtual PWM module further comprises:

a virtual PWM module to define periodic cycle counts for a combination of real PWM levels to achieve a desired virtual PWM level.

7. The vacuum control system of claim 5, further comprising:

an extrapolation module to extrapolate expected output vacuum levels corresponding to various input PWM levels in view of a single vacuum level measurement by the vacuum sensor.

8. A computer-readable storage medium containing instructions that, when executed, cause a computer to:

receive an indication of a vacuum level measured at a vacuum source in a printing device by a vacuum sensor, the vacuum level associated with a pulse-width modulation (PWM) level for a PWM controller;

compare the vacuum level to an expected vacuum level; and adjust the PWM level of the PWM controller in view of the comparison to achieve a virtual PWM level.

9. The computer-readable storage medium of claim 8, wherein the instructions that cause the computer to adjust the PWM level include further instructions that cause the computer to:

extrapolate vacuum levels for various PWM levels based at least in part on the received indication of the vacuum level to determine the virtual PWM level.

10. The computer-readable storage medium of claim 9, wherein extrapolated PWM levels include real PWM levels and virtual PWM levels.

11. The computer-readable storage medium of claim 8, wherein the instructions that cause the computer to adjust the PWM level include further instructions that cause the computer to:

communicate to the PWM controller a periodic cycle count for each of two consecutive real PWM levels to be used in achieving the adjusted PWM level.

* * * * *